US011413721B2

(12) United States Patent
Altamirano

(10) Patent No.: US 11,413,721 B2
(45) Date of Patent: Aug. 16, 2022

(54) GRANITE POLISHING MACHINE

(71) Applicant: Silvano Altamirano, Miami, FL (US)

(72) Inventor: Silvano Altamirano, Miami, FL (US)

( * ) Notice: Subject to any disclaimer, the term of this patent is extended or adjusted under 35 U.S.C. 154(b) by 356 days.

(21) Appl. No.: 16/875,780

(22) Filed: May 15, 2020

(65) Prior Publication Data

US 2021/0354264 A1 Nov. 18, 2021

(51) Int. Cl.
*B24B 47/12* (2006.01)
*B24B 9/06* (2006.01)
*B24B 23/02* (2006.01)

(52) U.S. Cl.
CPC ..... *B24B 47/12* (2013.01); *B24B 9/06* (2013.01); *B24B 23/02* (2013.01)

(58) Field of Classification Search
CPC ..... B24B 47/12; B24B 9/06; B24B 23/02
USPC ..... 318/3; 451/359
See application file for complete search history.

(56) References Cited

U.S. PATENT DOCUMENTS 7,195,543 B2 * 3/2007 Cousin ..... B24B 53/053 451/21

* cited by examiner

*Primary Examiner* — David Luo
(74) *Attorney, Agent, or Firm* — Ruben Alcoba, Esq.

(57) ABSTRACT

A multi-wheel grinder tool that is comprised of a support platform, a motor, a grinder portion, a pulley system, a set of four pad drivers, a set of four square bearing housings, a set of four pad holders, a set of pins and a plurality of pads. The multi-wheel grinder tool is used polish edges of counter tops.

8 Claims, 8 Drawing Sheets

GRANITE POLISHING MACHINE

BACKGROUND

The present invention is directed to a multi-wheel grinder tool that is used to polish the edges of granite counter tops.

The invention is an improvement of the Inventor's prior patented invention, U.S. Pat. No. 9,289,872, which was titled Multi-Wheel Grinder Tool that was issued on Mar. 22, 2016.

The improvement of the present invention is its pad holders and how they polish the edges of counter tops.

Another improvement of the present invention is its driving mechanism. The driving mechanism has been structurally modified to be a pulley system rather than a gear system. The conversion to a pulley system has significantly reduced the weight of the present invention. Another benefit for using a pulley system is that the inventor has eliminated the need of using oil to lubricate the gears.

The present invention provides a multi-wheel grinder tool that polishes the edges of granite counter tops. In addition, the present invention eliminates the need of using oil to lubricate the gears of existing granite polishing machines.

SUMMARY

The multi-wheel grinder tool of the present invention is comprised of a support platform, a motor, a grinder portion, a pulley system, a set of four pad drivers, a set of four square bearing housings, a set of four pad holders, a set of pins and a plurality of pads.

An object of the present invention is to provide a multi-wheel grinding tool that uses a pulley system rather than a gear system, thereby minimizing the weight of the grinding tool.

Another object of the present invention is to provide a multi-wheel grinding tool that uses a pulley system rather than a gear system, thereby minimizing the need to use of oil to lubricate the present invention.

Still another object of the present invention is to provide a multi-wheel grinding tool that will maximize the area polished by the pads of the multi-wheel, grinding tool.

DRAWINGS

These and other features, aspects, and advantages of the present invention will become better understood with, regards to the following description, appended claims, and drawings where:

DESCRIPTION

Figure 1:
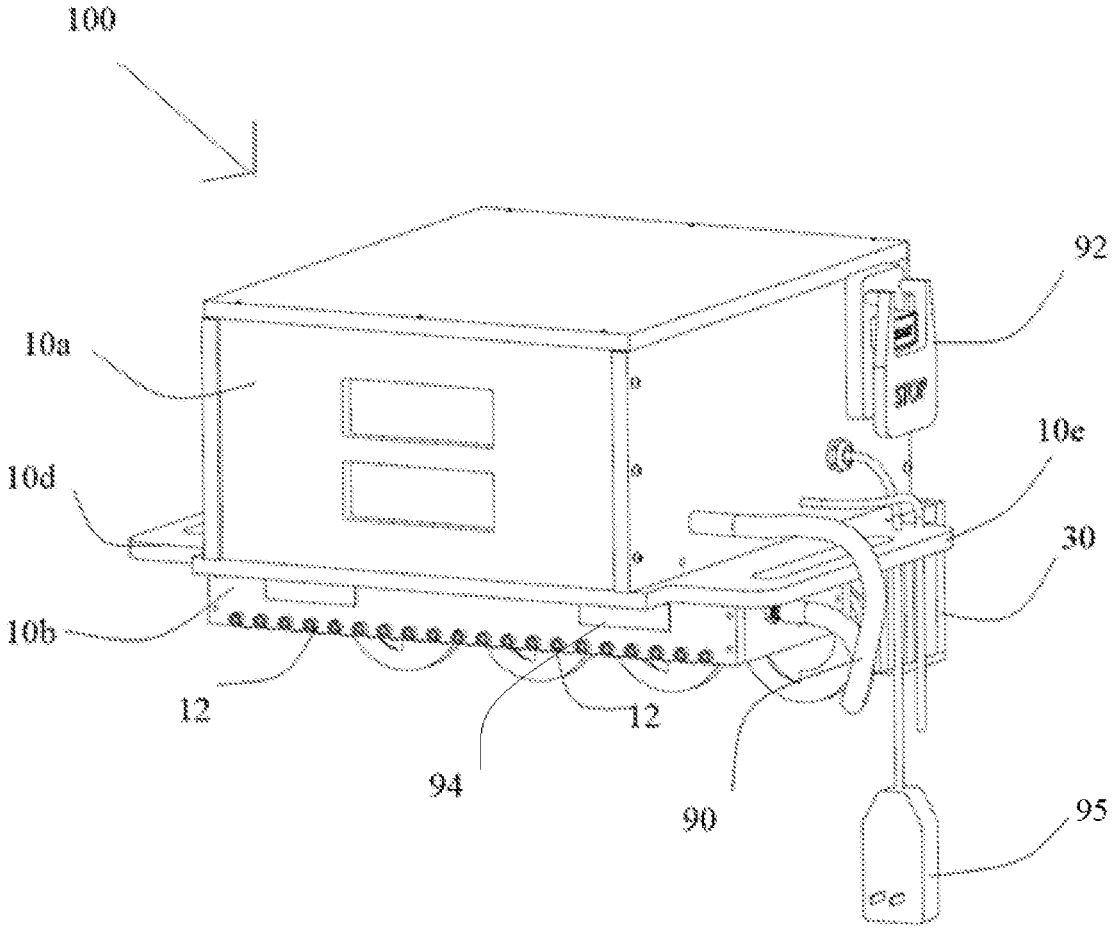
FIG. 1 is a perspective view of the present invention.
Figure 2:
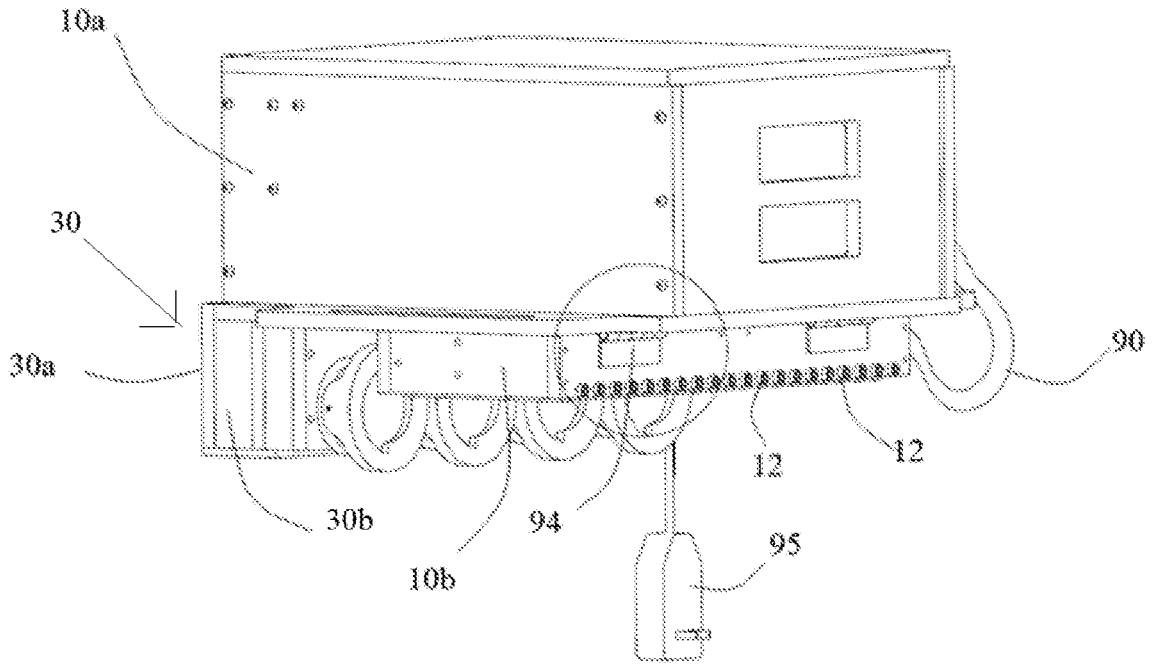
FIG. 2 is another perspective view of the present invention.
Figure 3:
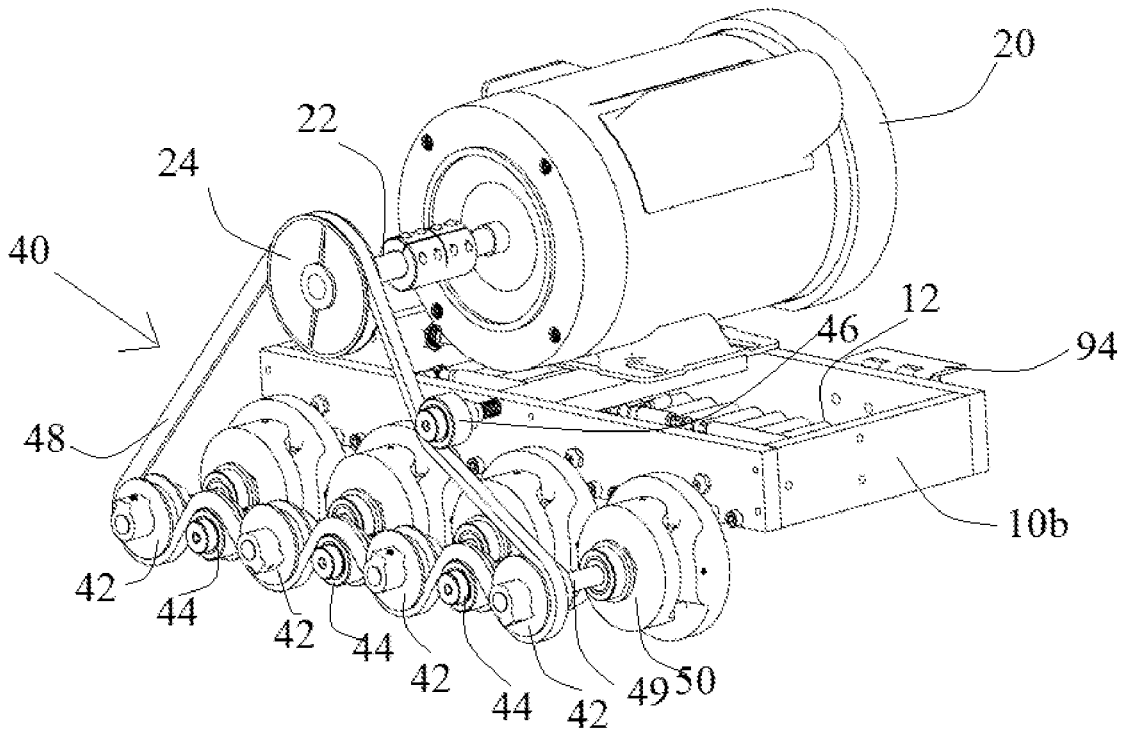
FIG. 3 is a perspective view of the present invention that shows the motor and pulley system of the present invention.
Figure 4:
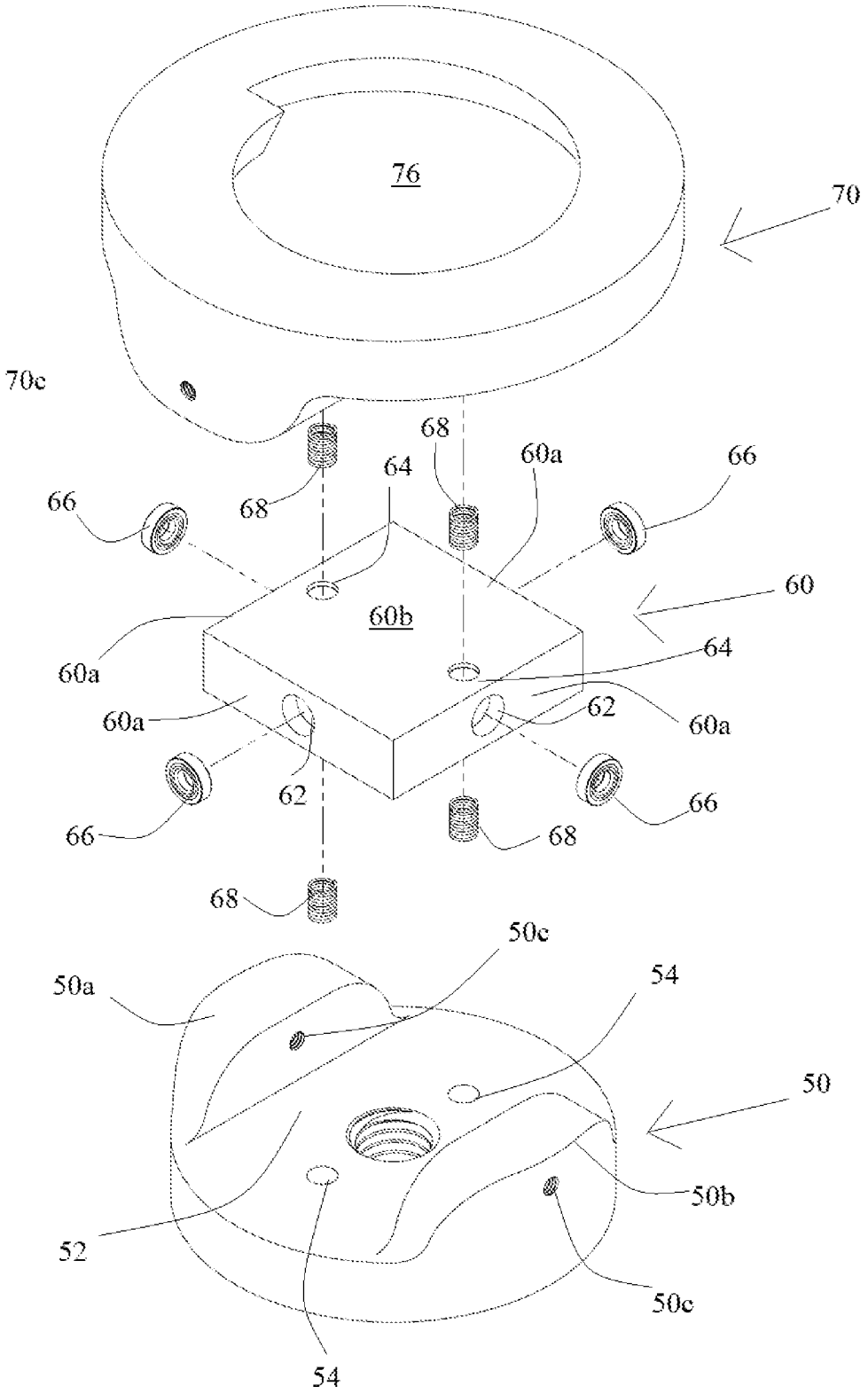
FIG. 4 is a perspective view of each pad driver, each square bearing housing and each pad holder of the present invention, wherein each pad driver is highlighted.
Figure 5:
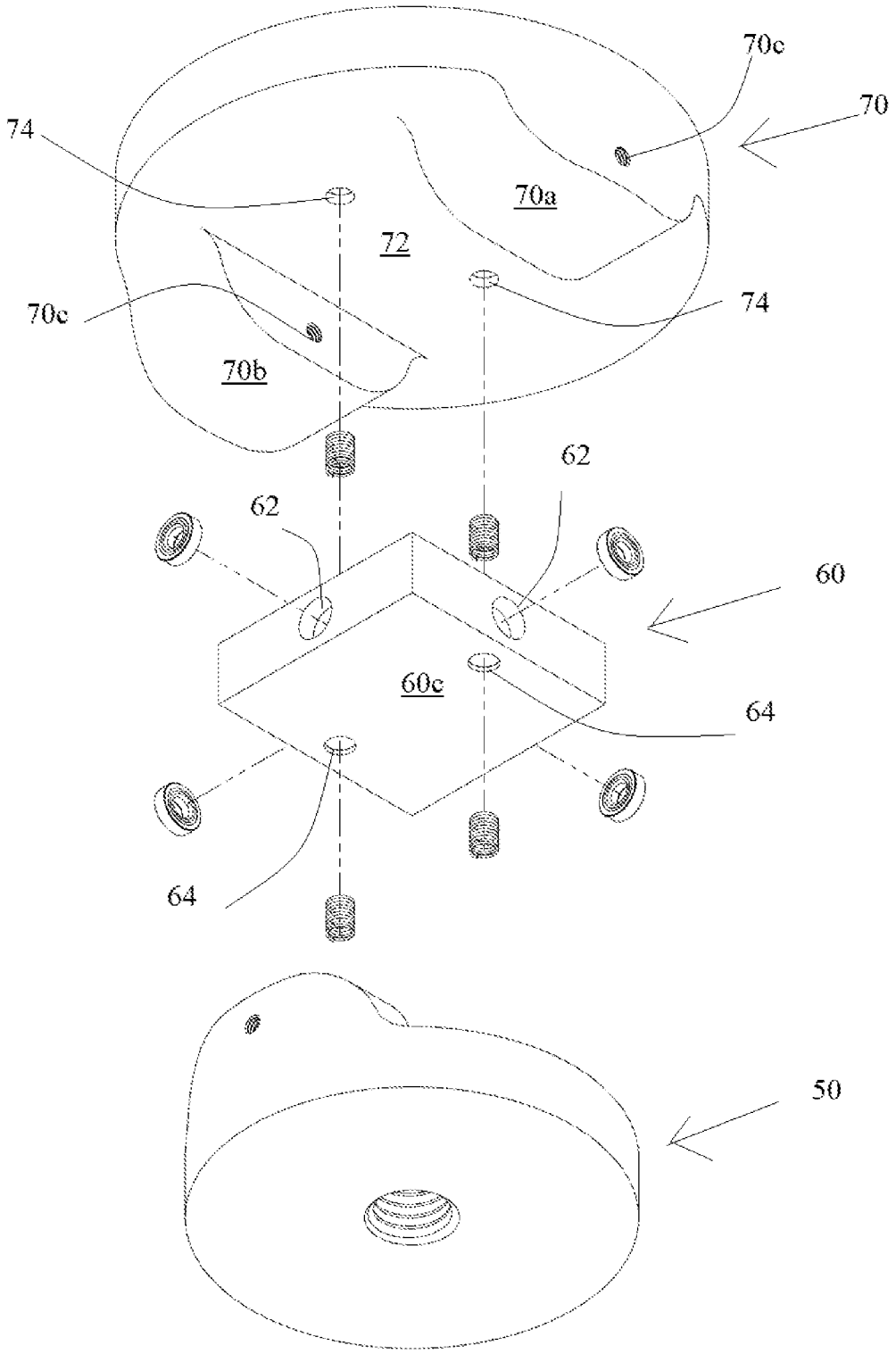
FIG. 5 is a perspective view of each pad driver, each square bearing housing and each pad holder of the present invention, wherein each pad holder is highlighted.
Figure 6:
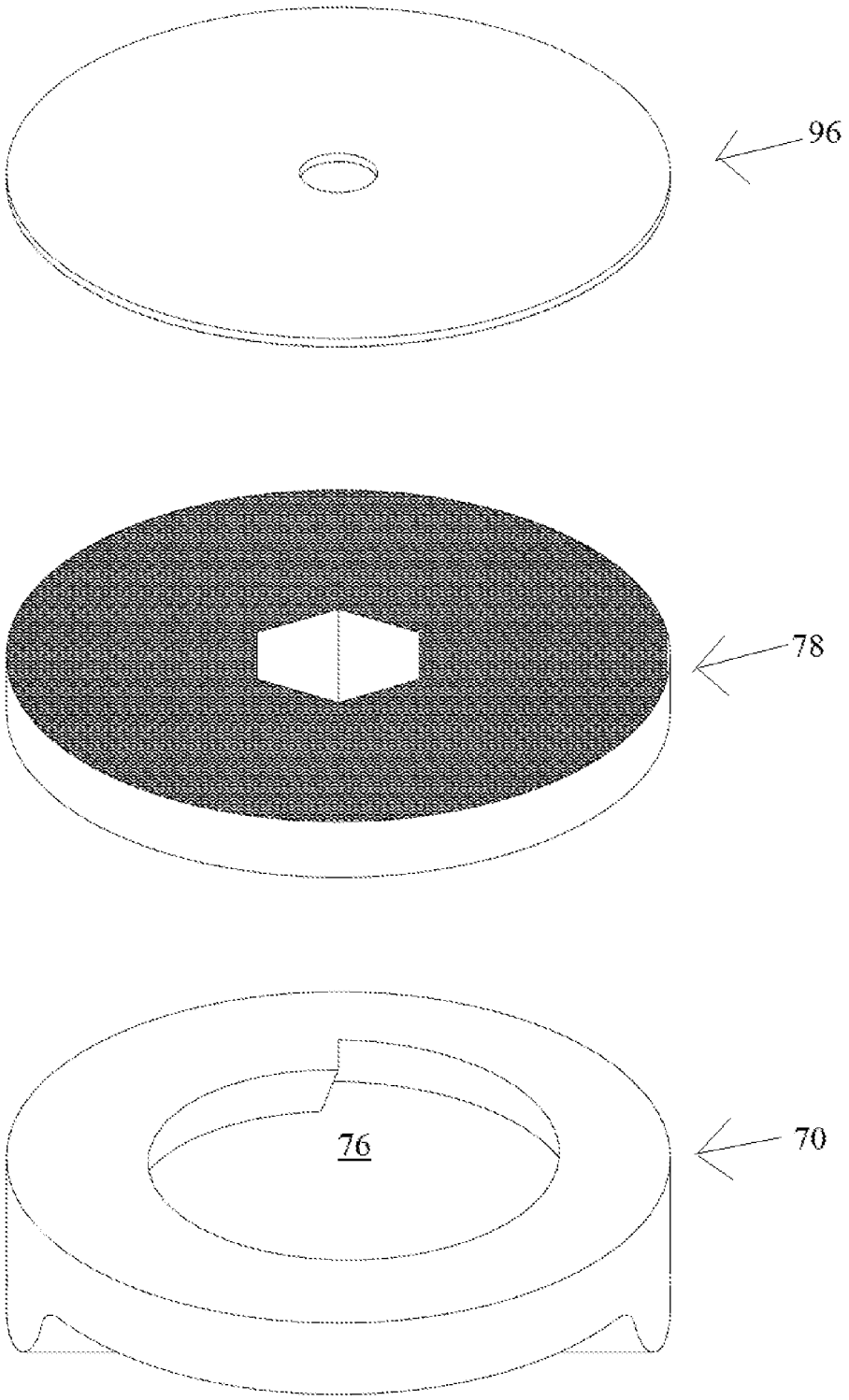
FIG. 6 is a perspective view that shows each pad holder, each snail lock, pad adaptor and each pad of the present invention.
Figure 7:
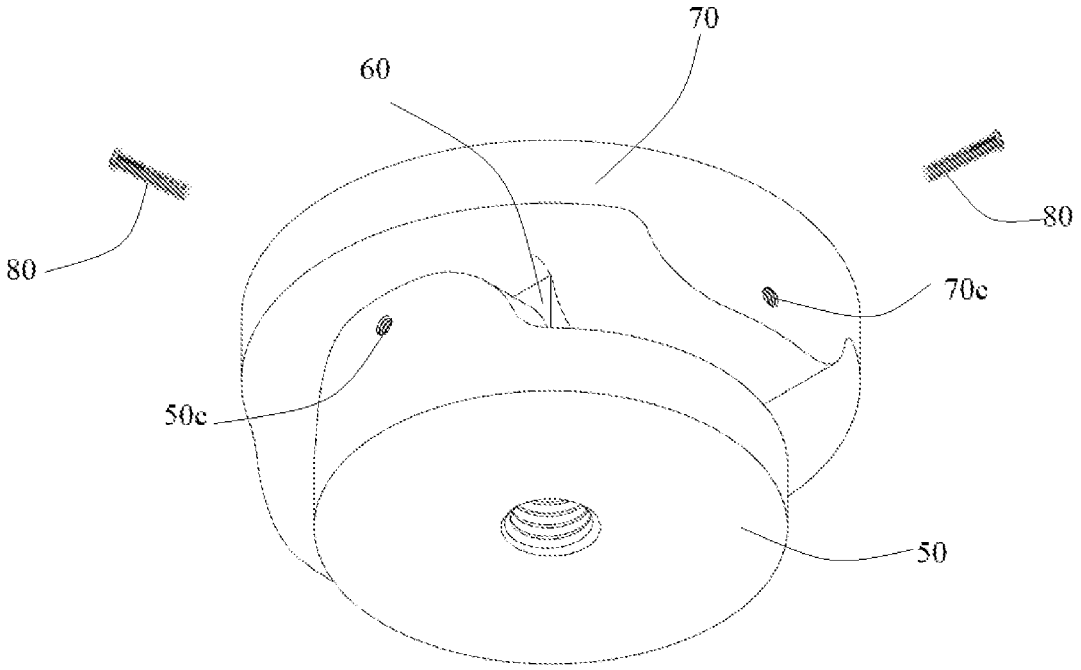
FIG. 7 is a perspective view of each pad driver, each square bearing and each pad holder attached together.
Figure 8:
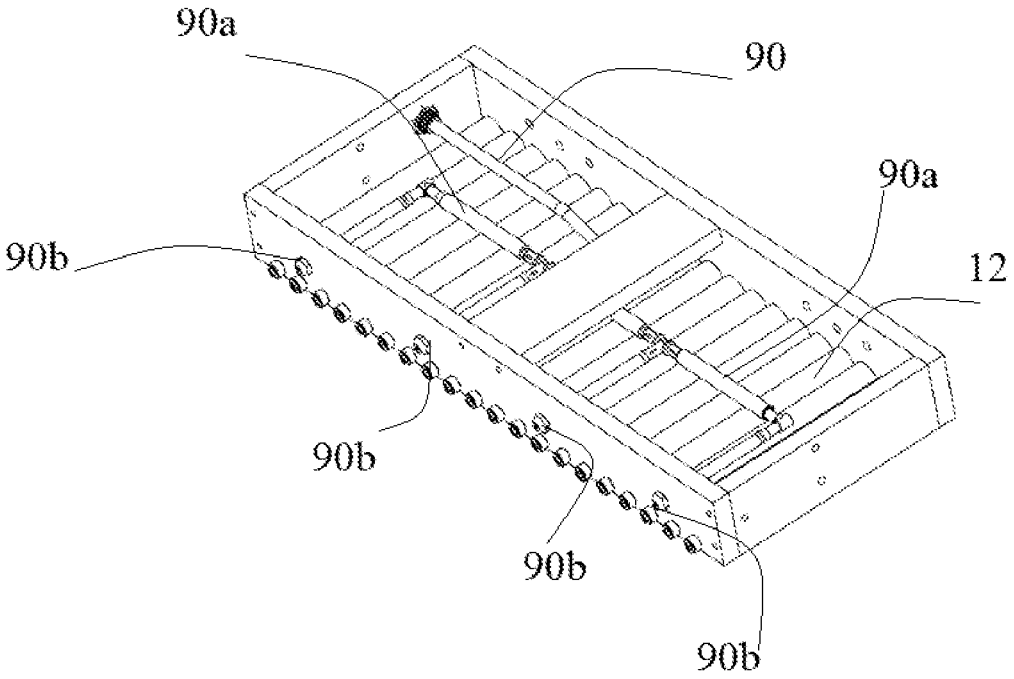
FIG. 8 is a perspective view the water system of the present invention.

As seen in FIGS. 1-8, the present invention is a multi-wheel grinder tool 100 that is used to polish edges of counter tops.

The multi-wheel grinder tool 100 comprises of a support platform 10 defined by a handling surface 10*a* and an engagement surface 10*b*, the engagement surface 10*b* has a plurality of rollers 12. A motor 20 disposed is within the handling surface 10*a* of the support platform 10, the motor 20 has a motor axel 22, a motor pulley wheel 24 attaches to the motor axel 22. A grinder portion 30 has a grinder housing 30*a* that defines a cavity 30*b*, the grinder portion 30 is attached to the support platform 10*a*. A pulley system 40 is disposed within the cavity 30*b* of the grinder housing 30*a* and the handling surface 10*a*, wherein the pulley system 40 has four pulley wheels 42 that are arranged horizontally linearly within the grinder housing 10*a*, three idle pulleys 44 that are staggered between each pulley wheel 42, a belt tension wheel 46 that is positioned at a position that is above the four pulley wheels 42 and that is secured to the handling surface 10*a* and a drive belt 48 that operatively connects the motor pulley wheel 24, the four pulley wheels 42, the idle pulleys 44 and the belt tension wheel 46 so that the four pulley system 40 has each of the four pulleys wheels 42 spin in the same direction and the idle pulleys 44 spin in an opposite direction to the four pulley wheels 42. A set of four pad drivers 50, each pad driver 50 being attached to each of the four pulley wheels 42 via an axel 49, each of the four pad drivers 50 has a set of two opposite support surfaces 50*a*-50*b* that define a central pad driver attachment point 50*c* and between each opposite support surface 50*a*-50*b* a central channel 52 is defined, within the central channel 52 there is a set of two spring holding cavities 54 that run in the same direction as the central channel 52 and that are positioned at an equal distance from each opposite support surface 50*a*-50*b*. A set of four square bearing housings 60, each square bearing housing 60 has four lateral sides 60*a* and a front side 60*b* and a rear side 60*c*, each lateral side 60*a* of each four bearing housing 60 defines a bearing aperture 62 at a central location of each lateral side 60*a* and the front side 60*b* and the rear side 60*c* defines a set of two spring holding cavities 64, a set of sixteen bearings 66, each bearing 66 is inserted within each bearing aperture 62, a set of sixteen springs 68, each spring 68 is inserted within each spring holding cavity 64. A set of four pad holders 70, each pad holder 70 has a set of two opposite support surfaces 70*a*-70*b* that define a central pad holder attachment point 70*c* and between each opposite support surface 70*a*-70*b* a central channel 72 is defined, within the central channel 72 there is a set of two spring holding cavities 74 that run in the same direction as the central channel 72 and that are positioned at an equal distance from each opposite support surface 70*a*-70*b*, each pad holder 70 defines a snail lock aperture 76, and a set of four snail lock pad adaptors 78, wherein each snail lock pad adaptor 78 inserts within each snail lock aperture 76. And, a set of sixteen pins 80, after each square bearing housing 60 is aligned between each pad driver 50 and each pad holder 70, the pins 80 are inserted within each central pad driver attachment point 50*c* and each central pad holder attachment point 70*c*. The present invention is an improvement over a prior model that was described above in that the pads 96 that are used to grind the edge of a countertop can rotate in more than on one plane while polishing the edge of a granite countertop. This improvement allows the pads 96 that rotate the edge of countertops to polish the maximum amount of surface are in which they meet. The attachment of the pads to each snail lock pad adaptor 78 is described below.

In an embodiment of the present invention, a water spraying system 90 is disposed within the support platform 10 that has a water line 90*a* that is connected to a plurality of nozzles 90*b* that spray water toward each snail lock pad adapter 78. The water spraying system 90 cools pads 96 that are mounted on each snail lock adapter 78.

In another embodiment of the present invention, the multi-wheel grinder tool 100 comprises of an on and off switch 92 that controls the motor 20 and the water spraying system 90. A power source 95 attaches to the motor 20. The power source powers 95 the present invention.

In preferred embodiments, at least one hinge 94 is disposed between the engagement surface 10*b* and the support platform 10*a*, the at least one hinge 94 configured to enable the engagement surface 10*b* to pivot relative to the support platform 10*a*.

In another embodiment of the present invention, the handling surface 10 include a pair of handles 10*d*-10*e*. The pair of handles 10*d*-10*e* are used to move the multi-wheel grinder tool 100 horizontally over a countertop.

In all embodiments of the present invention, a plurality of pads 96 are removably attached to each snail lock pad adaptor 78. The pads 96 have a grit range that is from about 35 grit to about 120 grit.

An advantage of the present invention is that it provides a multi-wheel grinding tool that uses a pulley system rather than a gear system, thereby minimizing the weight of the grinding tool.

Another advantage of the present invention is that it provides a multi-wheel grinding tool that uses a pulley system rather than a gear system, thereby minimizing the need to use of oil to lubricate the present invention.

Still another advantage of the present invention is that it provides a multi-wheel grinding tool that maximizes the area polished by the pads of the multi-wheel grinding tool.

The embodiments of the inflatable boat fender described herein are exemplary and numerous modifications, combinations, variations, and rearrangements can be readily envisioned to achieve an equivalent result, all of which are intended to be embraced within the scope of the appended claims. Further, nothing in the above-provided discussions of the inflatable boat fender should be construed as limiting the invention to an embodiment or a combination of embodiments. The scope of the invention is defined by the appended claims.

What is claimed is:

1. A multi-wheel grinder tool for increasing the longitudinal surface area for grinding across the edge of a stone slab, the tool comprising:

a support platform defined by a handling surface and an engagement surface, the engagement surface has a plurality of rollers;

a motor disposed within the handling surface of the support platform, the motor has a motor axel, a motor pulley wheel attaches to the motor axel;

a grinder portion has a grinder housing that defines a cavity, the grinder portion is attached to the support platform;

a pulley system is disposed within the cavity of the grinder housing and the handling surface, wherein the pulley system has four pulley wheels that are arranged horizontally linearly within the grinder housing, three idle pulleys that are staggered between each pulley wheel, a belt tension wheel that is positioned at a position that is above the four pulley wheels and that is secured to the handling surface and a drive belt that operatively connects the motor pulley wheel, four pulley wheels, the idle pulleys and the belt tension wheel so that the four pulley system has each of the four pulley wheels spin in the same direction and the idle pulleys spin in an opposite direction to the four pulley wheels;

a set of four pad drivers, each pad driver being attached to each of the four pulleys via an axel, each of the four pad drivers has a set of two opposite support surfaces that define a central pad driver attachment point and between each opposite support surface a central channel is defined, within the central channel there is a set of two spring holding cavities that run in the same direction as the central channel and that are positioned at an equal distance from each opposite support surface;

a set of four square bearing housings, each square bearing housing has four lateral sides and a front side and a rear side, each lateral side of each four bearing housing defines a bearing aperture at a central location of each lateral side and the front side and the rear side defines a set of two spring holding cavities, a set of sixteen bearings, each bearing is inserted within each bearing aperture, a set of sixteen springs, each spring is inserted within each spring holding cavity;

a set of four pad holders, each pad holder has a set of two opposite support surfaces that define a central pad holder attachment point and between each opposite support surface a central channel is defined, within the central channel there is a set of two spring holding cavities that run in the same direction as the central channel and that are positioned at an equal distance from each opposite support surface, each pad holder defines a snail lock aperture, and a set of four snail lock pad adaptors, wherein each snail lock pad adaptor inserts within each snail lock aperture; and a set of sixteen pins, after each square bearing housing is aligned between each pad driver and each pad holder, the pins are inserted within each central pad driver attachment point and each central pad holder attachment point.

2. The tool of claim 1, comprising a water spraying system that is disposed within the support platform that has a water line that is connected to a plurality of nozzles that spray water toward each snail lock pad adapter.

3. The tool of claim 2, comprising an on and off switch that controls the motor and the water spraying system.

4. The tool of claim 3, comprising a power source that attaches to the motor.

5. The tool of claim 4, comprising at least one hinge disposed between the engagement surface and the support platform, the at least one hinge is configured to enable the engagement surface to pivot relative to the support platform.

6. The tool of claim 5, wherein the handling surface include a pair of handles.

7. The tool of claim 6, comprising a plurality of pads that are removably attached to each snail lock pad adaptor.

8. The tool of claim 7, wherein the pads have a grit range that is from about 35 grit to about 120 grit.

* * * * *